US010941529B1

(12) United States Patent
Bigham et al.

(10) Patent No.: US 10,941,529 B1
(45) Date of Patent: Mar. 9, 2021

(54) BLADE ASSEMBLY FOR WORK VEHICLES

(71) Applicant: National Flooring Equipment, Inc., Minneapolis, MN (US)

(72) Inventors: William Bigham, Thornton, CO (US); Tyler Midas, Minneapolis, MN (US)

(73) Assignee: National Flooring Equipment, Inc., Minneapolis, MN (US)

( * ) Notice: Subject to any disclaimer, the term of this patent is extended or adjusted under 35 U.S.C. 154(b) by 0 days.

(21) Appl. No.: 16/890,361

(22) Filed: Jun. 2, 2020

(51) Int. Cl.
*A47L 13/02* (2006.01)
*E01C 23/12* (2006.01)

(52) U.S. Cl.
CPC ..... *E01C 23/121* (2013.01); *A47L 13/02* (2013.01)

(58) Field of Classification Search
CPC ..... E04G 23/006; A47L 13/02; E04D 15/02; E04D 15/003
USPC ..... 15/93.1, 236.01; 299/36.1, 37.1; 30/169, 30/170, 172; 81/45
See application file for complete search history.

(56) References Cited

U.S. PATENT DOCUMENTS

| | | | | |
|---|---|---|---|---|
| 909,406 | A | 1/1909 | Hearing | |
| 960,787 | A | 6/1910 | Beeler | |
| 2,245,544 | A | 6/1941 | Miller | |
| 2,747,309 | A * | 5/1956 | Cooper | E02F 3/8152 172/778 |
| 2,769,626 | A | 11/1956 | Becker | |
| 2,906,514 | A | 9/1959 | Becker | |
| 3,010,744 | A | 11/1961 | Hollis | |
| 4,550,512 | A | 11/1985 | Felstet | |
| 4,668,017 | A | 5/1987 | Peterson et al. | |
| 5,197,784 | A | 3/1993 | Holder | |
| 5,641,206 | A | 6/1997 | Craft | |
| 5,830,313 | A | 11/1998 | Smith | |
| 6,135,566 | A | 10/2000 | Anderson | |
| 6,264,282 | B1 | 7/2001 | Gaumont | |
| 6,343,981 | B1 | 2/2002 | Buchanan | |
| 7,562,412 | B1 | 7/2009 | Anderson | |
| 2020/0190835 | A1 | 6/2020 | Burk | |

* cited by examiner

*Primary Examiner* — Sunil Singh
(74) *Attorney, Agent, or Firm* — Thomas J. Nikolai; DeWitt LLP

(57) ABSTRACT

A blade assembly for removing a membrane from a bridge deck during a road resurfacing project includes a plurality of independently mounted blades that are able to conform to the contours of a bridge deck, separate the membrane from the bridge deck, and form the separated portions of the membrane into narrow strips or rolls.

10 Claims, 5 Drawing Sheets

BLADE ASSEMBLY FOR WORK VEHICLES

CROSS-REFERENCED TO RELATED APPLICATIONS

Not applicable.

STATEMENT REGARDING FEDERALLY SPONSORED RESEARCH OR DEVELOPMENT

Not applicable.

BACKGROUND OF THE INVENTION

I. Field of the Invention

The present invention relates to blade assemblies for work vehicles. More specifically, the present invention relates to blade assemblies attached to work vehicles and used to remove polymeric membranes from bridge decks and the like during road resurfacing projects.

II. Related Art

To protect against corrosion, waterproof polymeric membranes are typically applied to bridge decks prior to applying a surface coating of asphalt or concrete to complete construction of the bridge. Such polymeric membranes have been applied in sheet or roll form, but more typically are sprayed onto the bridge deck and allowed to set up prior to application of the concrete or asphalt surface layer.

Whether made of asphalt or concrete, such surface layers deteriorate over time. Such deterioration may be caused by settling of the structure, weather conditions, or the application of corrosive salts and other chemicals in cold climates to prevent the build-up of ice on the roadway. Repairs can be periodically made to the existing surface layer to address potholes, cracks, or the like. However, eventually the surface layer will need to be replaced. Whenever the surface layer is replaced, it is typically necessary to also remove and replace the polymeric membrane beneath the surface layer.

Removal of the membrane from a bridge deck has proven to be a difficult task for several reasons. First, the membrane is adhered to the bridge deck and substantial sheering forces are required to release the membrane from the bridge deck. This problem is exacerbated by the nature of such membranes. The materials used to form such membranes are very strong and elastomeric making them difficult to cut. The membranes typically extend in an uninterrupted fashion over the entire width of the bridge. The elastomeric materials used tend to be very dense, and even small sections of such membranes are extremely heavy. This problem is further exacerbated by the usual unevenness of the bridge deck to which the membrane was applied.

Various machines have been employed to remove such membranes. This job is typically performed using a skid steer. The bucket of the skid steer is used to try to dig through the membrane and then pry the membrane off the bridge deck. This has proven to be a very time consuming and inefficient task because the skid steer's bucket is simply not the right tool for the job.

SUMMARY OF THE INVENTION

The present invention solves the foregoing problems by providing a blade assembly comprising a blade frame that cooperates with a plurality of blade holders to carry a plurality of blades. More specifically, the blade frame comprising a front curved nose section having a top and a bottom, a bottom section extending rearwardly from the bottom of the front curved nose section, a top section extending upwardly and rearwardly from the top of the front curved nose section, a plurality of openings extending through the front curved nose section, and separate collars mounted within each of the plurality of openings.

Separate blade holders may be mounted to the blade frame. More specifically, each blade holder comprises a shank having a longitudinal axis. The shank is adapted to be received within one of the plurality of collars of the blade frame and rotate about the longitudinal axis of the shank when the shank is received within the collar. Each blade holder also includes a base plate fixed to the shank. At least one clamping member is also included as a part of each blade holder. The clamping member is adapted to be selectively coupled to the base plate of the blade holder using bolts or some other suitable fastener.

The blade holders are each used to attach a separate blade to the blade frame. Each such blade comprises a blade plate having a rear edge, a front tapered scraping edge, a left side and a right side. Each blade also includes left and right wings. More specifically, the left wing and the right wing each comprise a lower section extending outwardly and upwardly from the blade plate and an upper section extending upwardly from the lower section. Each wing also includes a forward-facing front sheering edge formed by the forward surfaces of the upper and lower sections. The blade plates of the blades are adapted to be clamped between the base plate and the clamping member(s).

When the individual blades are attached to the individual blade holders and the individual blade holders are attached to the collars of the blade frame, each blade will rotate independently of each other with respect to the blade frame.

The blade assembly is intended to be attached to a work vehicle. It is important that the entire blade assembly be able to tilt relative to the work vehicle. This permits the angle of the blades to be adjusted for proper engagement of the membrane to be removed. As such, the bottom section of the blade frame comprises a mounting plate. A first set of mounting members extends from the mounting plate. This first set of mounting members is employed to pivotally mount the blade frame to a work vehicle using one or more pivot pins. A second set of mounting members also extends from the mounting plate. The mounting members of this second set are employed to couple the blade frame to one or more actuators (e.g., hydraulic cylinders) to pivot the blade frame relative to the work vehicle about the pivot pin(s) and hold the blades at a selected angle relative to the bridge deck and membrane to be removed from the bridge deck.

BRIEF DESCRIPTION OF THE DRAWINGS

The foregoing features, objects and advantages of the invention will become apparent to those skilled in the art from the following detailed description and with reference to the following drawings in which like numerals in the several views refer to corresponding parts.

DETAILED DESCRIPTION

Figure 1:
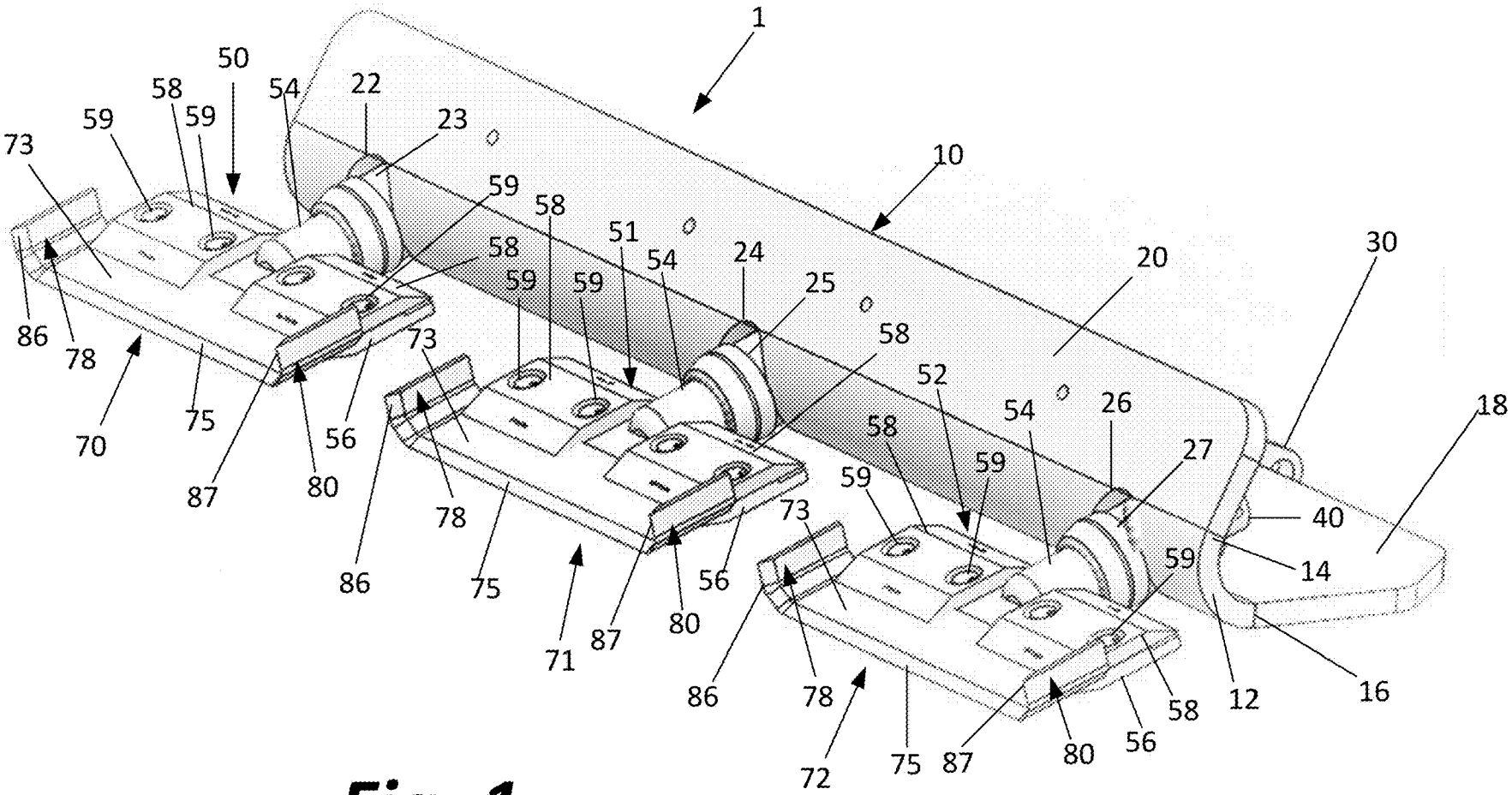
FIG. 1 is a perspective view of the front of an exemplary blade assembly made in accordance with the present invention.

This description of the preferred embodiment is intended to be read in connection with the accompanying drawings, which are to be considered part of the entire written description of this invention. In the description, relative terms such as "lower", "upper", "horizontal", "vertical", "above", "below", "up", "down", "top" and "bottom", "under", as well as derivatives thereof (e.g., "horizontally", "downwardly", "upwardly", "underside", etc.) should be construed to refer to the orientation as then described or as shown in the drawings under discussion. These relative terms are for convenience of description and do not require that the apparatus be constructed or operated in a particular orientation. Terms such as "connected", "connecting", "attached", "attaching", "joined", and "joining" are used interchangeably and refer to one structure or surface being secured to another structure or surface or integrally fabricated in one piece unless expressly described otherwise.

A blade assembly 1 made in accordance with the present invention is shown in the drawings. The blade assembly 1 includes a blade frame 10, a plurality of blade holders 50, 51 and 52, and a plurality of blades 70, 71 and 72.

The blade frame 10 includes a front curved nose section 12 having a top 14 and a bottom 16. Extending rearwardly and upwardly from top 14 is a top section 20 of the blade frame 10. Extending from the bottom 16 is a bottom section 18.

The front curved nose section 12 has a plurality of openings 22, 24 and 26 extending therethrough. Positioned adjacent (e.g., within) each of openings 22, 24 and 26 is a collar. As shown, collar 23 extends through opening 22, collar 25 extends through opening 24, and collar 27 extends through opening 26. Two or more than three such openings and associated collars may be provided without deviating from the invention.

Figure 8:
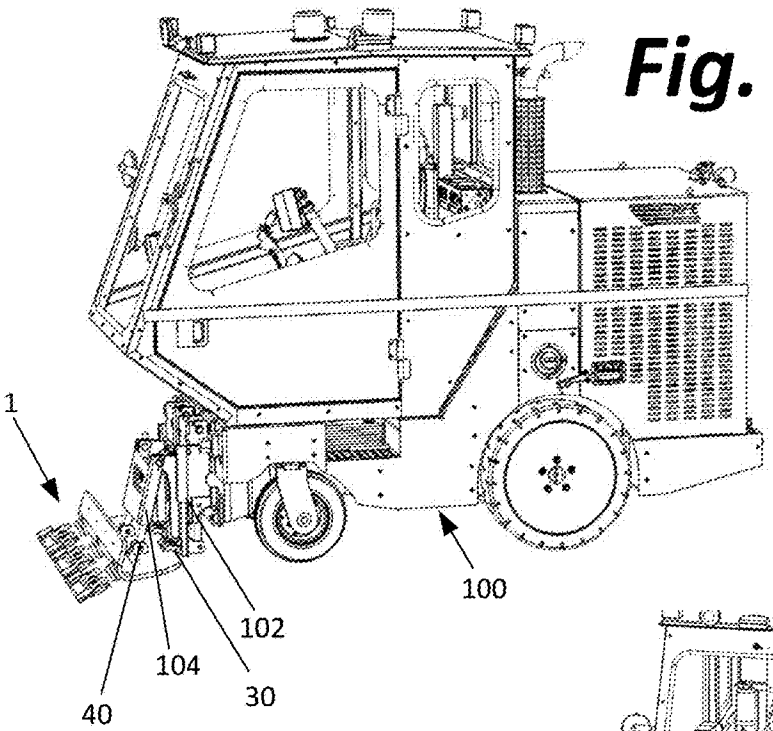
FIG. 8 is a perspective view showing the blade assembly of FIG. 1 attached to a work vehicle.

Secured to the bottom section 18 of the blade frame 10 are at least two sets of mounting members. As shown in the drawings, the first set of mounting members includes mounting members 30-37 and the second set of mounting members includes mounting members 40-43. Mounting members 30-37 are adapted to receive one or more pivot pins (not shown) that are used to attach the blade assembly 1 to a work vehicle 100 in a manner that allows the entire blade assembly to be tilted about the pivot pins relative to the work vehicle 100. As shown in FIG. 8, the mounting members 30-37 are coupled to actuator(s) 102 of the work vehicle 100. The hydraulic actuator(s) 102 shown are hydraulic cylinder(s) that may be used to raise and lower the entire blade assembly 1. Mounting members 40-43 are attached one or more actuators 104 of the work vehicle 100. The hydraulic actuators 104 are used to adjust and hold the tilt angle of the blade assembly 1 relative to the work vehicle. The actuators 104 may, for example, be hydraulic cylinders that are extended to tilt the blade frame 10 down or retracted to tilt the blade 10 up about the pivot pins relative to the work vehicle 100.

Figure 2:
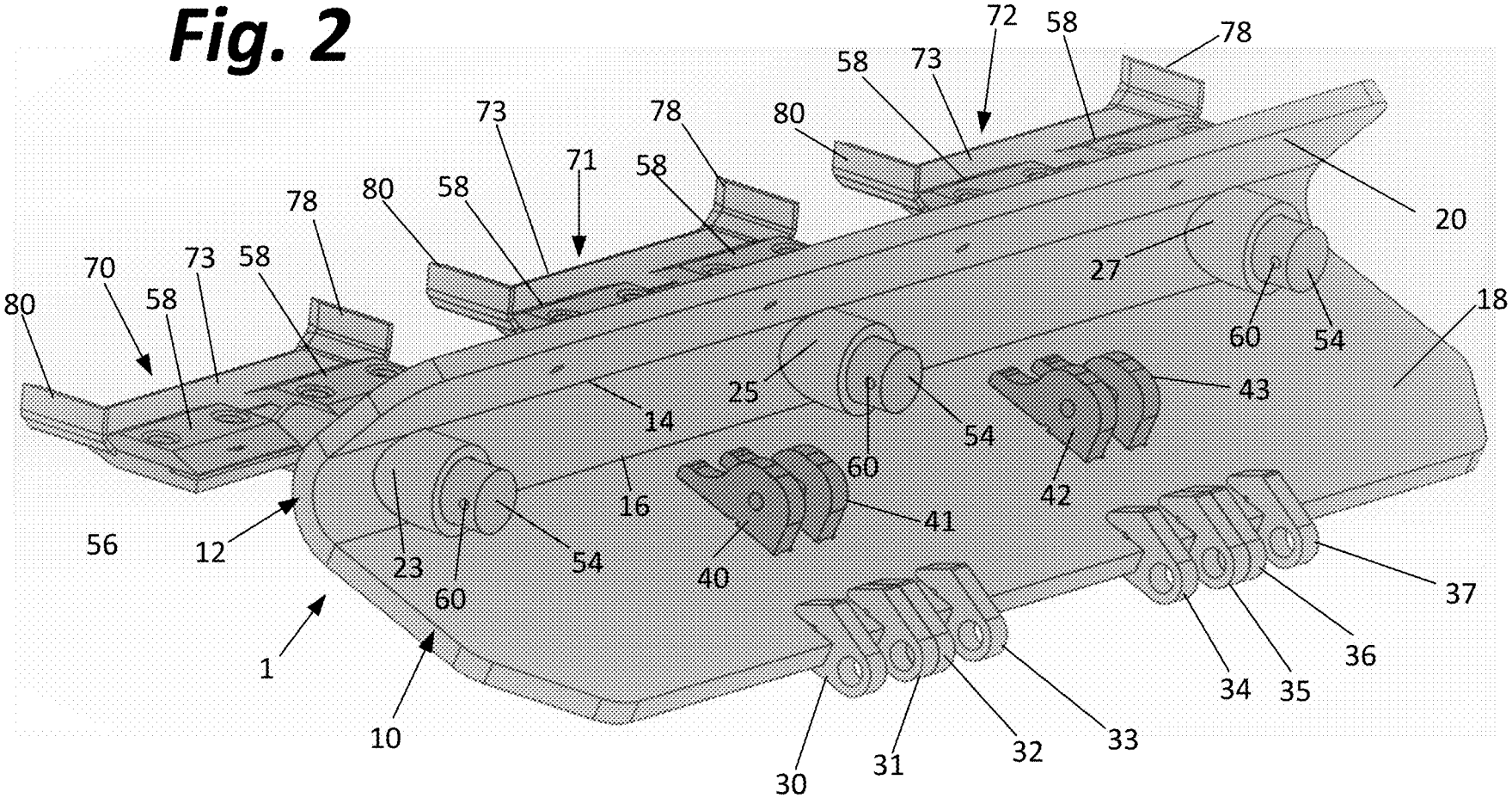
FIG. 2 is a perspective view of the rear of the blade assembly of FIG. 1.
Figure 3:
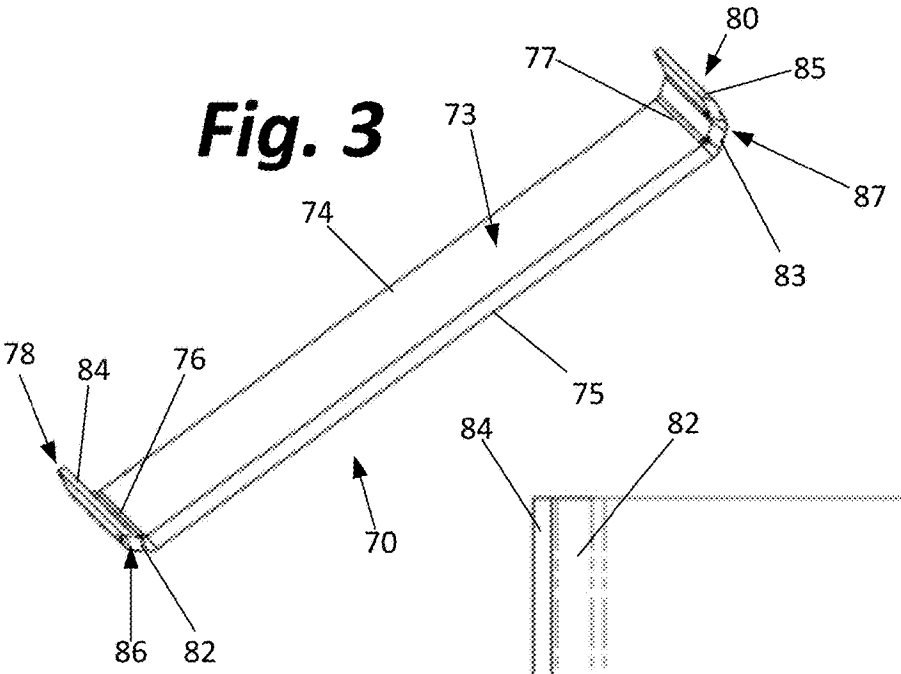
FIG. 3 is a perspective view of one of the blades of the blade assembly of FIG. 1.
Figure 4:
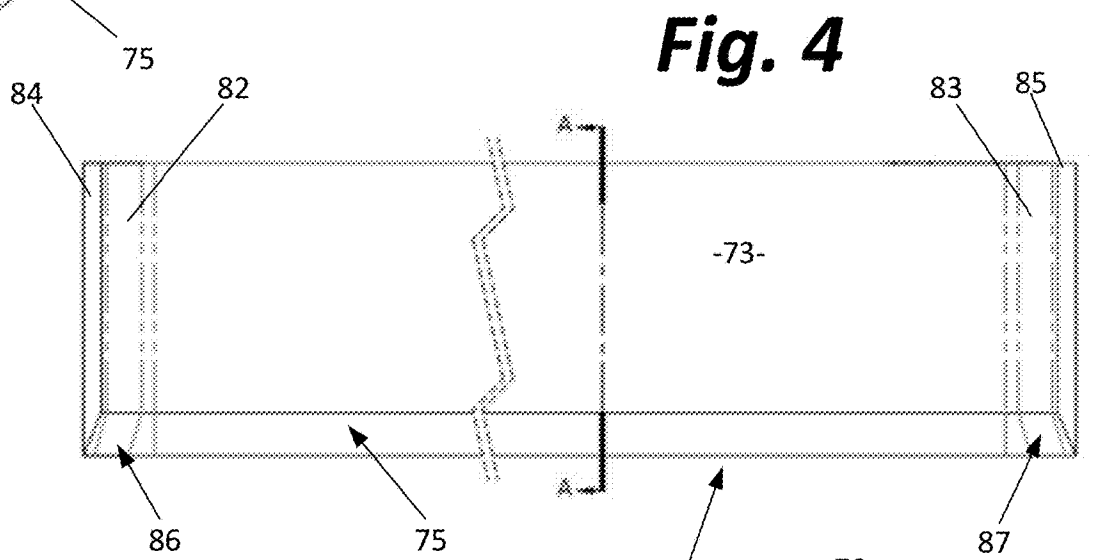
FIG. 4 is top plan view of the blade of FIG. 3.
Figure 5:
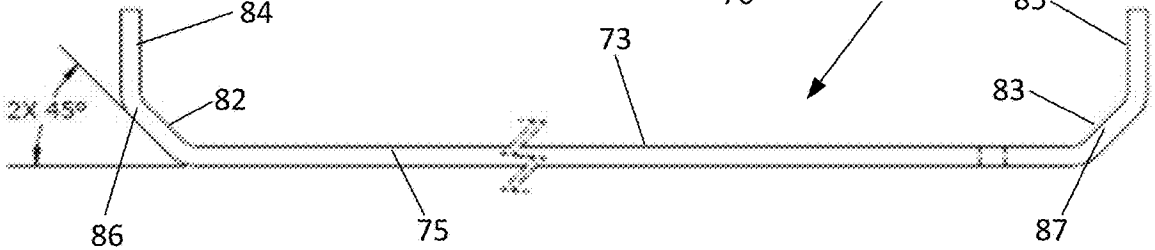
FIG. 5 is a front plan view of the blade of FIG. 3.
Figure 7:
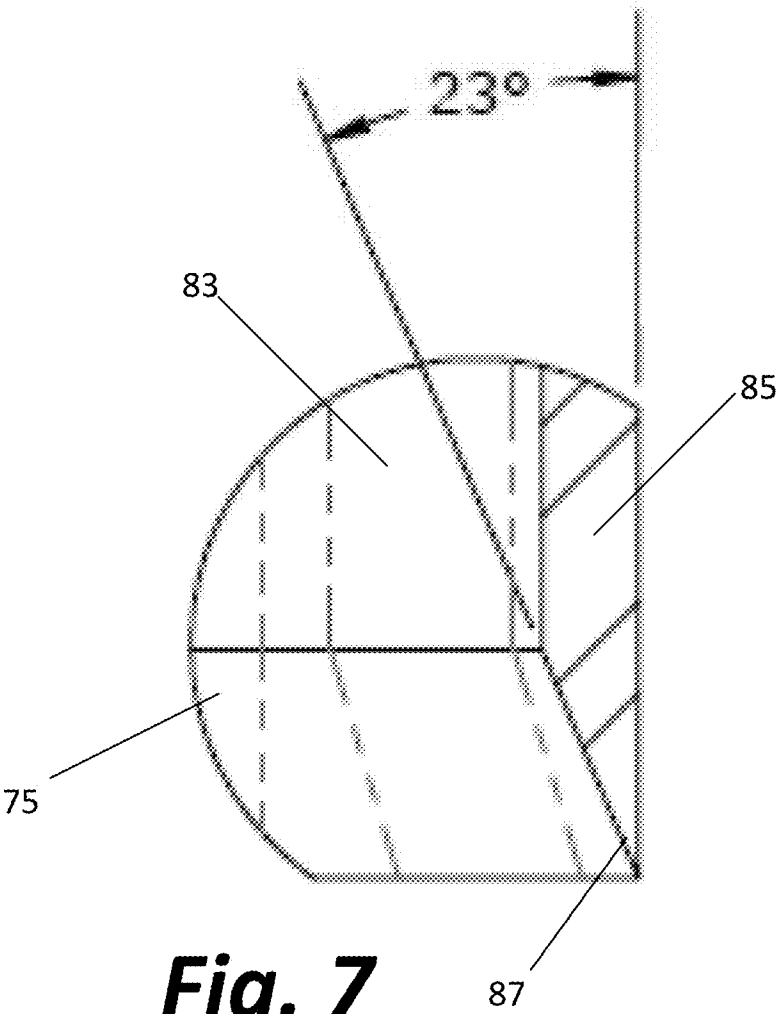
FIG. 7 is view of that portion of FIG. 6 within circle B of FIG. 6.
Figure 6:
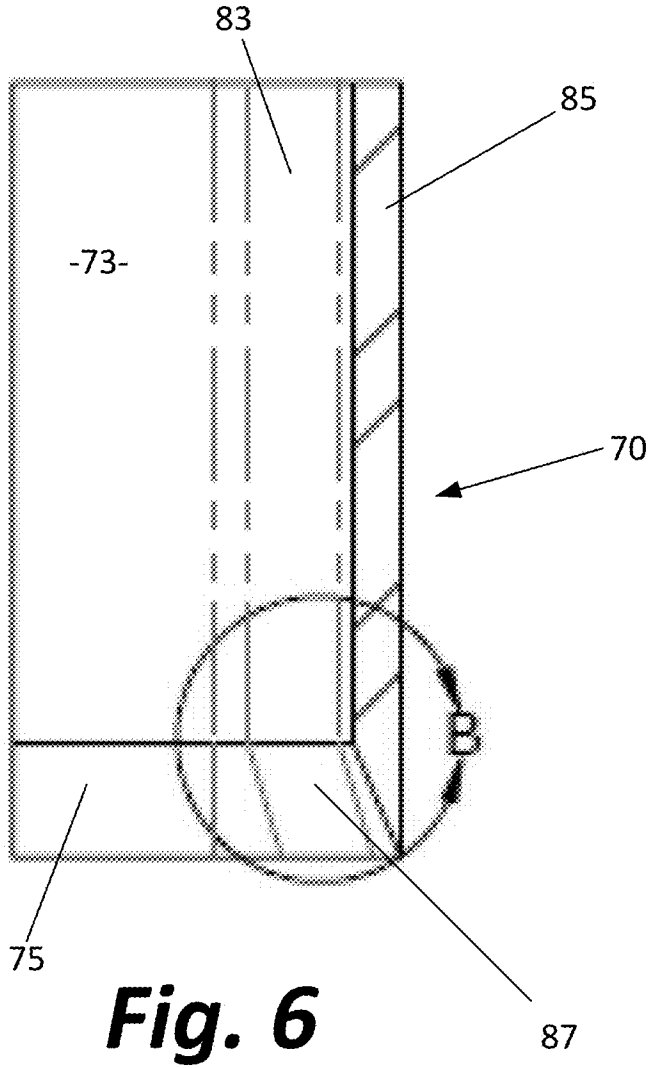
FIG. 6 is a cross-sectional view of the blade of FIG. 3 taken through line A-A in FIG. 4.

The blade holders 50-52 are assembled in a like manner. Each includes a shank 54 adapted to be inserted into and extend through one of the collars 23, 25, 27. When so received, the shank can rotate about the shank's longitudinal axis within the collar. As best shown in FIG. 2, the shank 54 extends through and past the collar and has an opening 60 adjacent the free end of the shank 54 adapted to receive a locking member, e.g., a cotter pin or bolt (not shown), to prevent the shank 54 from being inadvertently dislodged from the collar.

The other end of the shank 54 is coupled to a base plate 56. In addition to the shank 54 and the base plate 56, each of the blade holders 50, 51 and 52 include at least one clamping member 58. In the drawings, each of the blade holders 50, 51 and 52 include two such clamping members 58. Bolts 59 are used to selectively fix the clamping members 58 to the base plate 56.

At shown in the drawings, each of the three blade holders 50, 51, and 52 hold a separate blade 70, 71 and 72. Of course, when a different number of collars than the three shown are provided, the number of blade holders and blades provided will typically be different than the three shown.

Each of the blades 70, 71 and 72 includes a blade plate 73. The blade plate 73 has a rear edge 74, a front tapered skiving edge 75, a left edge 76 and a right edge 77. Extending from the left edge 76 is a left wing 78 and extending from the right edge 77 is a right wing 80. The left wing 78 has a left wing lower section 82 extending upwardly and outwardly at an angle of 45 degrees from the left edge 76 of the blade plate 73. The left wing 78 also has a left wing upper section 84 extending upwardly from the left wing lower section 82 at an angle of 45 degrees. As such, the left wing upper section extends perpendicularly with respect to the blade plate 73. The front edges of the left wing lower section and left wing upper section are tapered to form a left wing sheering edge 86.

The right wing 80 is constructed in a similar fashion. More specifically, the right wing 80 has a right wing lower section 83 extending upwardly and outwardly at an angle of 45 degrees from the right edge 77 of the blade plate 73. The right wing 80 also has a right wing upper section 85 extending upwardly from the right wing lower section 83 at an angle of 45 degrees. As such, the right wing upper section 85 extends perpendicularly with respect to the blade plate 73. The front edges of the right wing lower section 83 and right wing upper section 85 are tapered to form a right wing sheering edge 87.

When the blade assembly is in use, the blades 70, 71 and 72 are attached to the blade holders 50, 51 and 52 by sandwiching each blade's blade plate 73 between a base plate 52 and clamping member(s) 58 of a blade holder. The bolts 59 are then inserted through the clamping members and tightened into threaded holes (not shown) in the base plate 52 to secure the blade to the blade holder. After the blades 70, 71 and 72 have been so attached to the blade holders 50, 51 and 52, the shank 54 of each blade holder is inserted through one of the collars 23, 25 and 27 to complete the assembly of blade assembly 1.

As described above, the blade assembly 1 is attached to a work vehicle using the two sets of mounting members, i.e., the first set comprising mounting members 30-37 and the second set comprising mounting members 40-43. The actuators 100 of the work vehicle are then manipulated to raise or lower the blade assembly to a desired heights relative to the bridge deck and actuators 104 of the work vehicle 100 are then manipulated to tilt the blades 70, 71, and 72 to a desired angle. More specifically, the blades 70, 71 and 72 are tilted so that the front tapered skiving edge 75 of each of the blades is positioned between a bridge deck and a membrane to be removed from the bridge deck. As the work vehicle 100 is then driven in the forward direction, the front tapered skiving edge 75 of each of blades 70, 71 and 72 scrapes (i.e., separates) the membrane from the bridge deck. As the membrane is separated from the bridge deck, the membrane is also sliced into strips roughly the same width as each blade by the left wing sheering edge 86 and right wing sheering edge 87 of each blade. When three blades are used as shown, three such strips are created. As the work vehicle continues forward, the strips are formed into rolls given the design of the blades 70, 71 and 72, blade holders 50, 51, and 52, and the front curved nose section 12 and top section 20 of the blade frame 10. When the rolls are of a suitable size, the forward progress of the work vehicle is temporarily stopped, and the rolls are cut from the remainder of the membrane and removed from the vehicle's path. The skiving, slicing, and rolling process is then continued.

As noted above, each of the blades and blade holders rotate independently of each other about the longitudinal axis of the blade holder shanks 54 of the individual blade holders 50, 51 and 52. This is important to limit the effects of any unevenness in the top surface of the bridge deck from which the membrane is being removed. Such unevenness is one of the reasons a standard bucket of a skid steer is not up to the task.

To maximize efficiency when removing a membrane from a bridge deck, all components of the blade assembly are made of very strong and durable materials. This permits the entire weight of the front of the work vehicle, and even additional weight supplied by auxiliary weights (not shown), to be carried by the blade assembly. This occurs when the blade assembly is lowered and tilted into a membrane skiving position.

Various modifications may be made without deviating from the invention. For example, the nose 12 of the blade frame 10 may be flat rather than curved.

Figure 9:
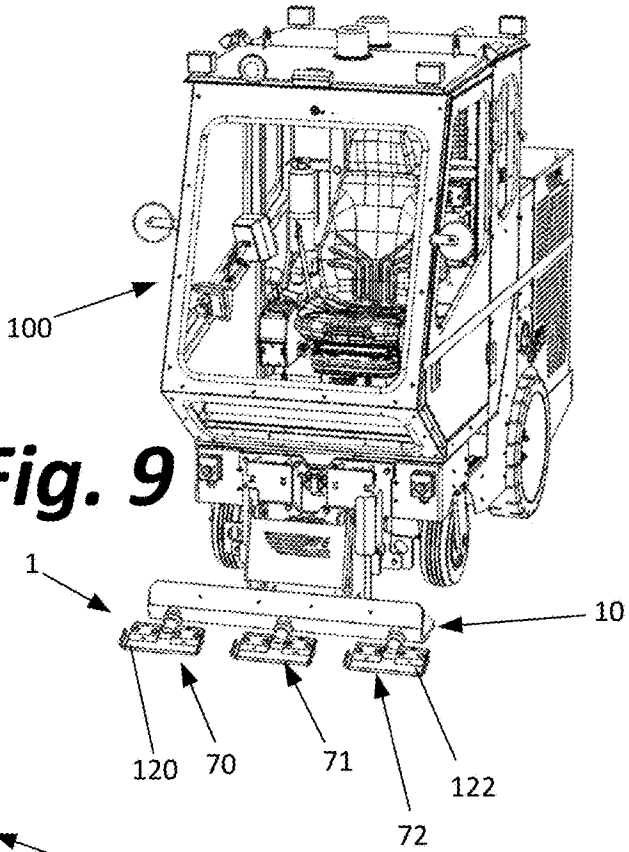
FIG. 9 is another perspective view showing the blade assembly of FIG. 1 attached to a work vehicle.

Also, and as shown in FIG. 9, the blade assembly 1 may be constructed so that it is wider than the work vehicle 100. Further, and as also shown in FIG. 9, the blade assembly 1 may be designed so that blade 70 has a blade portion 120 extending outwardly past the left edge of the blade frame 10 and the blade 72 has a blade portion 122 extending outwardly past right edge of the blade frame 10. Doing so allows an operator of the work vehicle 100 to scrape the membrane more easily from the edges of the roadway of the bridge adjacent a curb.

Figure 10:
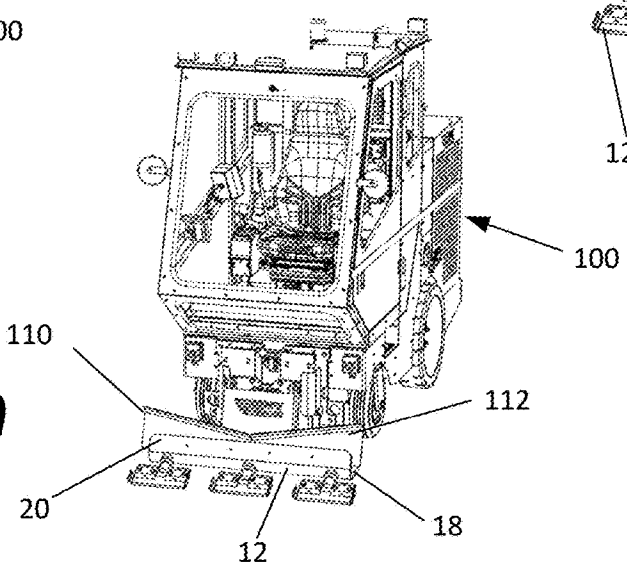
FIG. 10 is a perspective view showing an alternative embodiment of the blade assembly attached to a work vehicle.

The blade assembly 1 may also include diverters 110 and 112. As shown in FIG. 10, these diverters 110 and 112 extend upwardly from the bottom section 18 behind the top section 20. Diverters 110 and 112 intersect along a line at approximately the center of the blade frame and extend outwardly and rearwardly from this line. The diverters serve to push the skived membrane outside of the path of work vehicle 100.

It should be understood that, within the scope of the following claims, the invention may be practiced otherwise than as specifically shown in the drawings and described above. The foregoing description is intended to explain the various features and advantages, but is not intended to be limiting. The scope of the invention is defined by the following claims which are also intended to cover a reasonable range of equivalents.

What is claimed is:

1. A blade assembly comprising:

a. a blade frame comprising a front nose section having a top and a bottom, a bottom section extending rearwardly from the bottom of the front nose section, a top section extending upwardly and rearwardly from the top of the front nose section, a first opening extending through the front nose section, a second opening extending through the front nose section, a first collar mounted within the first opening, and a second collar mounted within the second opening;

b. a first blade holder comprising a first shank, a first base plate fixed to the first shank, at least one first clamping member adapted to be selectively coupled to the first base plate, wherein said first shank is adapted to be received and rotated within the first collar;

c. a second blade holder comprising a second shank, a second base plate fixed to the second shank, at least one second clamping member adapted to be selectively coupled to the second base plate, wherein said second shank is adapted to be received and rotated within the second collar;

d. a first blade comprising (i) a first blade plate having a first rear edge, a first front tapered skiving edge, a first left side and a first right side, (ii) a first left wing comprising a first left wing lower section extending outwardly and upwardly from the first left side, a first left wing upper section extending upwardly from the first left wing lower section, and a first left wing front sheering edge, and (iii) a first right wing comprising a first right wing lower section extending outwardly and upwardly from the first right side, a first right wing upper section extending upwardly from the first right wing lower section, and a first right wing front sheering edge, wherein said first blade plate is adapted to be clamped between the first base plate and the at least one first clamping member; and e. a second blade comprising (i) a second blade plate having a second rear edge, a second front tapered skiving edge, a second left side and a second right side, (ii) a second left wing comprising a second left wing lower section extending outwardly and upwardly from the second left side, a second left wing upper section extending upwardly from the second left wing lower section, and a second left wing front sheering edge, and (iii) a second right wing comprising a second right wing lower section extending outwardly and upwardly from the second right side, a second right wing upper section extending upwardly from the second right wing lower section, and a second right wing front sheering edge, wherein said second blade plate is adapted to be clamped between the second base plate and the at least one second clamping member.

2. The blade assembly of claim 1 wherein the blade frame further comprises a third opening extending through the front nose section, and a third collar mounted within the third opening.

3. The blade assembly of claim 2 further comprising a third blade holder comprising a third shank, a third base plate fixed to the third shank, at least one third clamping member adapted to be selectively coupled to the third base plate, wherein said third shank is adapted to be received and rotated within the third collar.

4. The blade assembly of claim 3 further comprising a third blade comprising (i) a third blade plate having a third rear edge, a third front tapered skiving edge, a third left side and a third right side, (ii) a third left wing comprising a third left wing lower section extending outwardly and upwardly from the third left side, a third left wing upper section extending upwardly from the third left wing lower section, and a third left wing front sheering edge, and (iii) a third right wing comprising a third right wing lower section extending outwardly and upwardly from the third right side, a third right wing upper section extending upwardly from the third right wing lower section, and a third right wing front sheering edge, wherein said third blade plate is adapted to be clamped between the third base plate and the at least one third clamping member.

5. The blade assembly of claim 1 wherein said first left wing lower section extends at an angle of 45 degrees from the first base plate, and the first left wing upper section is perpendicular to the first base plate.

6. The blade assembly of claim 1 wherein the bottom section of the blade frame comprises a mounting plate, a first set of mounting members and a second set of mounting members, the first set of mounting members adapted to be employed to pivotally mount the blade frame to a work vehicle, and said second set of mounting members adapted to couple the blade frame to a first actuator adapted to tilt the blade frame relative to the work vehicle.

7. The blade assembly of claim 6 wherein said first set of mounting members is further adapted to be couple to a second actuator for raising and lowering the blade assembly.

8. The blade assembly of claim 1 wherein said first shank has a first pin hole extending therethrough adapted to selectively receive a first pin to prevent the first shank from decoupling from the first collar.

9. The blade assembly of claim 1 wherein said blade frame has a right edge and a left edge, the first blade has a first blade portion extending outwardly past the left edge and the second blade has a second blade portion extending outwardly past the right edge.

10. The blade assembly of claim 1 further comprising at least one diverter.

* * * * *